US008290392B2

(12) United States Patent
Takayanagi

(10) Patent No.: US 8,290,392 B2
(45) **Date of Patent: *Oct. 16, 2012**

(54) IMAGE FORMING APPARATUS WITH CLEANING MEMBER TO REMOVE TONER FROM TRANSFER ROLLER

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/828,516

(22) Filed: Jul. 1, 2010

(65) Prior Publication Data

US 2010/0266309 A1 Oct. 21, 2010

Related U.S. Application Data

(62) Division of application No. 11/691,133, filed on Mar. 26, 2007, now Pat. No. 7,773,907.

(30) Foreign Application Priority Data

Apr. 3, 2006 (JP) ..... 2006-101826

(51) Int. Cl.
*G03G 15/16* (2006.01)

(52) U.S. Cl. ..... 399/101

(58) Field of Classification Search ..... 399/66, 399/99, 101, 313
See application file for complete search history.

(56) References Cited

U.S. PATENT DOCUMENTS

| | | | | |
|---|---|---|---|---|
| 5,729,788 | A | 3/1998 | Hirohashi et al. | |
| 7,385,737 | B2 | 6/2008 | Zaima | |
| 2003/0128381 | A1 | 7/2003 | Zaima | |
| 2003/0161652 | A1* | 8/2003 | Nishiwaki | 399/101 |
| 2005/0141920 | A1* | 6/2005 | Sato et al. | |
| 2005/0207779 | A1 | 9/2005 | Takahashi et al. | |
| 2005/0220478 | A1 | 10/2005 | Ai et al. | |
| 2005/0238382 | A1* | 10/2005 | Takei | 399/101 |
| 2006/0083538 | A1 | 4/2006 | Terae et al. | |
| 2007/0059007 | A1 | 3/2007 | Ai | |

FOREIGN PATENT DOCUMENTS

| | | | |
|---|---|---|---|
| JP | 4-263279 | A | 9/1992 |
| JP | 7-281510 | A | 10/1995 |
| JP | 8-254909 | A | 10/1996 |
| JP | 8-314297 | A | 11/1996 |
| JP | 2000-75571 | A | 3/2000 |

* cited by examiner

*Primary Examiner* — Walter L Lindsay, Jr.
*Assistant Examiner* — Milton Gonzalez
(74) *Attorney, Agent, or Firm* — Fitzpatrick, Cella, Harper & Scinto

(57) ABSTRACT

An image forming apparatus includes an image bearing member; a rotatable transfer roller; a contact separation unit; a driving force transmission portion; a cleaning member; and a control portion. The cleaning member is for removing toner adhering to the transfer roller by contacting with the transfer roller when the transfer roller is in contact with and separated from the image bearing member. The cleaning member cleans the transfer roller in: (i) a first mode in which the cleaning member cleans the transfer roller while the transfer roller in contact with the image bearing member rotates at a first peripheral velocity, and (ii) a second mode in which the cleaning member cleans the transfer roller while the transfer roller separated from the image bearing member rotates at a second peripheral velocity. The control portion controls a voltage applied to the cleaning member according to the peripheral velocity of the transfer roller.

6 Claims, 7 Drawing Sheets

IMAGE FORMING APPARATUS WITH CLEANING MEMBER TO REMOVE TONER FROM TRANSFER ROLLER

This application is a divisional of U.S. patent application Ser. No. 11/691,133, filed Mar. 26, 2007.

BACKGROUND OF THE INVENTION

1. Field of the Invention

The present invention relates to a cleaning member which removes toner from a transfer roller for transferring a toner image on an image bearing member onto a recording material.

2. Description of the Related Art

In the field of an image forming apparatus, in particular, in a color image forming apparatus, an intermediate transfer system using an electronic photosensitive drum (to be referred as a photosensitive drum hereinafter) serving as an image bearing member or an endless intermediate transfer belt is frequently used. More specifically, a toner image obtained by developing an electrostatic latent image on the photosensitive drum with toner is temporarily transferred (primary transfer) on an intermediate transfer belt. The primary-transferred image is transferred (secondary transfer) on a sheet such as paper serving as a transferred material (recording material) fed to a nip portion between the intermediate transfer belt and a secondary transfer roller being in press contact with the intermediate transfer belt. The secondary transfer roller is brought into contact with an intermediate transfer belt. On the other hand, when the secondary transferring operation is not performed, the secondary transfer roller is separated from the intermediate transfer belt to reduce deterioration of the secondary transfer belt and the intermediate transfer belt. In execution of the secondary transferring operation, electric charges to form a transfer electric field are given to the secondary transfer roller, and the toner image is transferred from the intermediate transfer belt onto the sheet by a pressing force obtained by the transfer electric field and the secondary transfer roller.

In this case, in the image forming apparatus, when toner adheres to the secondary transfer roller, the toner is transferred onto the sheet in the secondary transferring operation to create a stain on the rear surface.

For this reason, a voltage is applied to a cleaning member being in contact with the rotating secondary transfer roller to cause a cleaning current to flow between the secondary transfer roller and the cleaning member so as to remove the toner adhering to the secondary transfer roller. In order to improve cleaning capability, the toner is removed from the secondary transfer roller when the secondary transfer roller is in contact with the intermediate transfer member and when the secondary transfer roller is separated from the intermediate transfer member.

However, when the secondary transfer roller is separated from the intermediate transfer belt, it is disadvantageously impossible to sufficiently remove the toner in the removal of toner from the secondary transfer roller.

More specifically, when the secondary transfer roller rotates while being in contact with the intermediate transfer member and rotated, rotation of the secondary transfer roller is adversely influenced by a rotating torque of the intermediate transfer member. When the secondary transfer roller is separated from the intermediate transfer belt, the secondary transfer roller is released from the influence of the go-around of the intermediate transfer belt, and a rotational velocity of the secondary transfer roller changes. With the change in rotational velocity, toner removal cannot be easily sufficiently removed.

SUMMARY OF THE INVENTION

It is an object of the present invention to appropriately remove toner from a transfer roller when the transfer roller is in contact with and separated from an image bearing member.

It is another object of the present invention to provide an image forming apparatus including:

an image bearing member which bears a toner image;

a transfer roller which forms a nip portion with the image bearing member while being rotated, transfers the toner image on the image bearing member onto a recording material nipped by the nip portion, and has a rotational velocity when the transfer roller is in contact with the image bearing member and a rotational velocity when the transfer roller is separated from the image bearing member, the rotational velocities being different from each other;

a cleaning member which is applied with a voltage while being in contact with the rotating transfer roller and removes toner adhering to the transfer roller when the transfer roller is in contact with and separated from the image bearing member; and control unit which changes voltages applied to the cleaning member such that a value of a current flowing between the transfer roller and the cleaning member when the transfer roller rotates while being in contact with the image bearing member and a value of a current flowing between the transfer roller and the cleaning member when the transfer roller rotates while being separated from the image bearing member are different from each other.

DESCRIPTION OF THE EMBODIMENTS

A preferred embodiment of an image forming apparatus according to the present invention will be described below with reference to the accompanying drawings.

Figure 1:
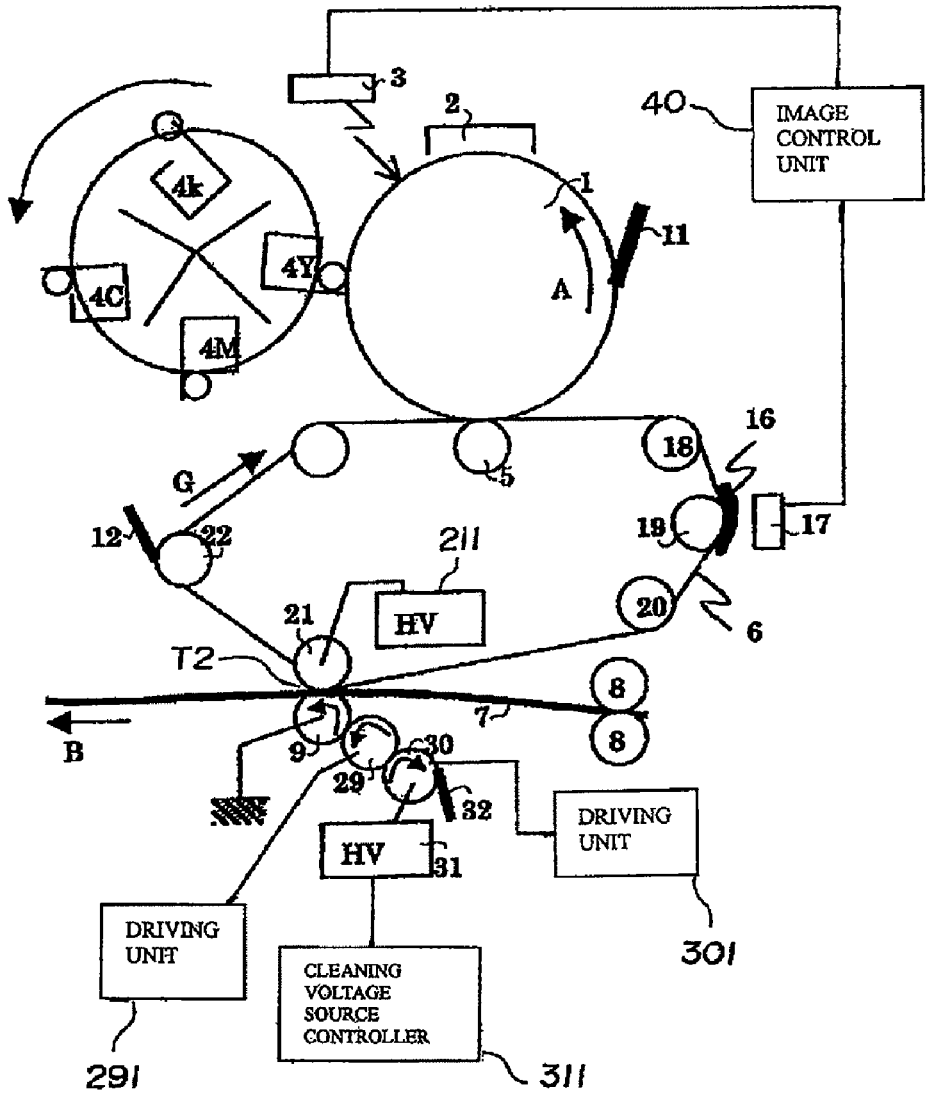
FIG. 1 is a diagram showing an embodiment of an image forming apparatus according to the present invention.

As shown in FIG. 1, a photosensitive drum 1 serving as an electrostatic image bearing member rotates in a counterclockwise direction indicated by an arrow A in FIG. 1, and the surface of the drum is applied with a charging bias voltage by an electric charging device 2 and uniformly electrically charged. An exposing unit 3 performs exposure on the basis of image information and forms an electrostatic latent image corresponding to the image information on the photosensitive drum 1 by electrophotographic processes.

For example, the image forming apparatus includes a rotary type developing unit in which developing devices 4Y, 4M, 4C, and 4*k* storing toners of Y (Yellow), M (Magenta), C (Cyan), and K (Black), respectively are radially equally spaced on the same circumference of a rotating body. The image forming apparatus employs an inversion developing system in which the electrostatic latent image on the photosensitive drum 1 is developed by the developing devices 4Y, 4M, 4C, and 4*k* to form a toner image on the drum surface, and negative toner is caused to adhere to an exposing portion of the electrostatic latent image, thereby developing the latent image.

The image forming apparatus according to the embodiment employs an intermediate transfer system which includes an endless intermediate transfer belt (intermediate transfer member) 6 which is an image bearing member and which runs at a rotational velocity of 285 mm/sec. The intermediate transfer belt 6 is winded between a plurality of rotating rollers 18 through 23, goes around in a clockwise direction indicated by an arrow G, and is brought into contact with the surface of the photosensitive drum 1 to primarily transfer the toner image on the drum. Certain ones of the rotating rollers have the following functions. The image forming apparatus has a tension roller 20 to give a predetermined tension to the intermediate transfer belt 6 and has a drive roller 22 which receives a rotating power output from a motor (not shown) of a rotating drive source to cause the intermediate transfer belt 6 to go around in the clockwise direction. The image forming apparatus has a counter 21 and a secondary transfer roller 9 which are paired to face each other and which secondarily transfers the toner image on the intermediate transfer belt 6 on a sheet 7, such as recording paper, which is a transferred material.

As a material of the intermediate transfer belt 6, the following various resins and rubber material can be used. For example, an appropriate amount of carbon black serving as an antistatic additive is contained in a resin or a rubber such as polyimide, polycarbonate, polyester, polypropylene, polyethylene terephthalate, acrylic, vinyl chloride. In this case, a material having a volume resistivity of, for example, 1E+8 to 1E+13 [Ω·cm] and a thickness of, for example, 0.07 to 0.1 [mm] can be used.

The intermediate transfer belt 6 is arranged to face the photosensitive drum 1, an unfixed-color toner image on the photosensitive drum 1 formed each time the intermediate transfer belt 6 goes around once is sequentially, electrostatically, primarily transferred on the intermediate transfer belt 6 by a primary transfer roller 5. This operation is repeated to obtain a toner image obtained by overlapping four unfixed toner images on the intermediate transfer belt 6.

Each time the photosensitive drum 1 rotates once in primary transferring, an image is formed while causing a drum cleaner 11 to remove residual toner remaining on the surface of the photosensitive drum 1. The primary transfer roller 5 presses the intermediate transfer belt 6 from behind at a primary transfer position where the intermediate transfer belt 6 faces the photosensitive drum 1 to bring the intermediate transfer belt 6 into contact with the photosensitive drum 1. A primary transfer bias having a positive polarity opposing the electric charging polarity of toner is applied to the primary transfer roller 5 to primarily transfer the toner image on the photosensitive drum 1 onto the intermediate transfer belt 6. The drum cleaner 11 removes toner remaining on the photosensitive drum 1 after the primary transferring operation.

In a secondary transfer portion T2 for the intermediate transfer belt 6 facing the conveyance path of the sheet 7, the secondary transfer roller 9 being in contact with a toner image bearing surface of the intermediate transfer belt 6 and a counter roller 21 being in contact with a rear side of the belt in opposition to the secondary transfer roller 9 are arranged.

The secondary transfer roller 9 is separated from the intermediate transfer belt 6 during the primary transferring operation. When the four full-color toner images of Y, M, C, and K are primarily transferred onto the intermediate transfer belt 6, in order to secondarily transfer the toner image on the intermediate transfer belt 6 onto the sheet 7, the secondary transfer roller 9 is brought into contact with the intermediate transfer belt 6 by a contact/separate mechanism (FIG. 5) (which will be described later). Upon completion of the secondary transferring operation, in preparation for the next primary transferring operation, the secondary transfer roller 9 is separated from the intermediate transfer belt 6.

The secondary transfer roller 9 is configured by shaping an elastic layer made of an ion conductor type solid rubber (NBR rubber) around, for example, a cored bar. The secondary transfer roller 9 which has an outer diameter of, for example, 24 mm, a roller surface coarseness of Ra=5.0 (μm) or less, and a resistance of 1 E+6 to 1E+8Ω measured at N/N (23° C., 50% RH) and an applied voltage of 2 kV can be used.

Figure 2:
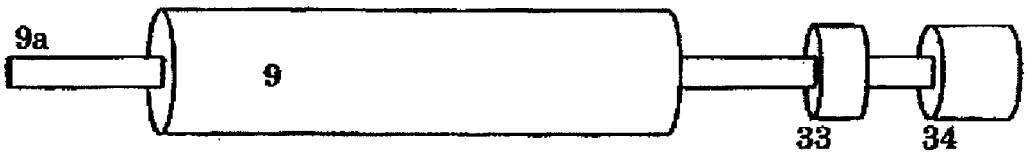
FIG. 2 is a diagram showing a secondary transfer roller serving as a main part of the embodiment.

FIG. 2 singularly shows the secondary transfer roller 9. An output shaft of a secondary transfer motor 34 is connected to one-end portion of a cored bar 9*a* serving as a rotating shaft through a torque limiter 33. The torque limiter 33 has a function that transmits a rotating power output from the motor 34 to the secondary transfer roller 9 depending on a set torque or interrupts the transmission. More specifically, when the set torque of the torque limiter 33 reaches 500 gf·cm, the torque limiter 33 interrupts transmission of the motor rotating power to the secondary transfer roller 9 to limit the power.

By the operation of the torque limiter 33, an excessive power is prevented from being transmitted to the secondary transfer roller 9 when the secondary transfer roller 9 is in contact with the intermediate transfer belt 6, so that the intermediate transfer belt 6 stably goes around.

As described above, the intermediate transfer belt 6 goes around at a peripheral velocity of 285 mm/sec. While the secondary transfer roller 9 is in contact with the intermediate transfer belt 6, transmission of driving force to the secondary transfer roller 9 is limited by the torque limiter 33, the secondary transfer roller 9 rotates at a peripheral velocity of 285 mm/sec which is equal to that of the intermediate transfer belt 6.

A fur brush roller 29 is arranged as a cleaning member so as to be in contact with the secondary transfer roller 9. A fur brush formed on the fur brush roller 29, has, for example, a hair length of 5 mm, a cored shaft diameter of 8 mm, an outer diameter of 18 mm, and a resistance of 1E+8 to 1E+10Ω measured at N/N (23° C., 50% RH) and an applied voltage of 100 V can be used. A bias roller 30 is arranged in contact with the fur brush roller 29. The bias roller 30 is applied with a voltage having a polarity opposing the polarity of toner by a cleaning bias applying unit 31. As the bias roller 30, a metal roller having an outer diameter of, for example, 15 mm and made of stainless steel (SUS) is used. The secondary transfer roller 9 and the bias roller 30 are inserted into the fur brush roller 29 in a depth of 1 to 2 mm.

The fur brush roller 29 is driven by a motor (driving unit) 291 and rotates in the same direction (counter direction) as that of the secondary transfer roller at a peripheral velocity of 70 mm/s. The bias roller 30 is driven by a motor (driving unit) 301 and rotates in the direction opposing the rotating direction of the fur brush roller 29.

In this embodiment, as will be described later, a toner image (to be referred to as a "patch image 16" hereinafter) serving as a reference pattern to control conditions for forming an image is formed. The patch image 16 is formed in a region corresponding to a sheet interval (paper interval) on the intermediate transfer belt 6. However, toner images are continuously formed on a plurality of sheets, the separating operation of the secondary transfer roller 9 is too late for the formation of the toner images, and a patch image is added to the secondary transfer roller 9.

A bias having a polarity opposing the polarity of toner is applied to the bias roller 30, and the patch image 16 adhering to the secondary transfer roller 9 is electrostatically transferred. The patch image 16 is transferred to the bias roller 30 and mechanically scratched off by a cleaning blade 32, and the toner is recovered in a waste toner vessel (not shown). A cleaning blade 32 is made of polyurethane rubber to have elasticity.

A belt cleaner 12 which removes toner remaining on the intermediate transfer belt 6 the after secondary transferring operation is arranged on a downstream side of the counter 21 and the secondary transfer roller 9 constituting the secondary transfer portion T2. The sheet 7 is temporarily stopped by a registration roller 8 and then fed to a secondary transfer position at a predetermined timing.

Figure 5A:
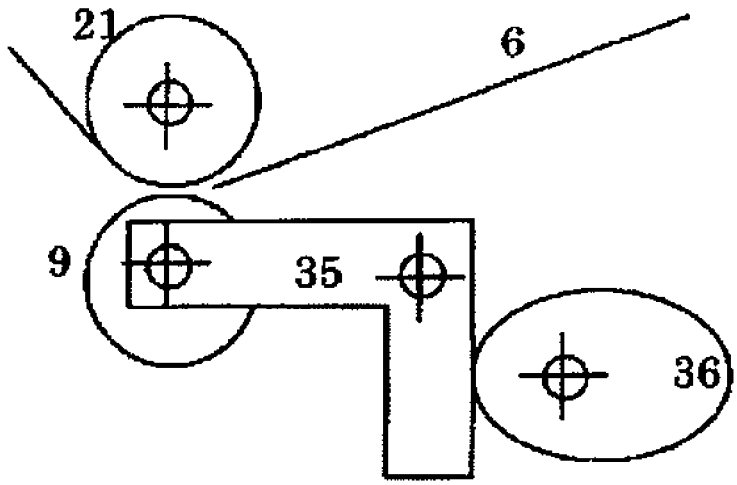
FIG. 5A is a diagram showing a state in which the secondary transfer roller is separated from an intermediate transfer belt.
Figure 5B:
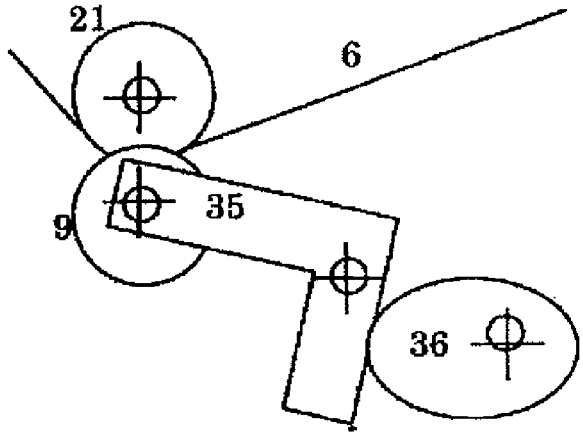
FIG. 5B is a diagram showing a state in which the secondary transfer roller is in contact with the intermediate transfer belt.

As shown in FIGS. 5A and 5B, the secondary transfer roller 9 is brought into contact with and separated from the intermediate transfer belt 6 by rotation of an eccentric cam 36 (contact/separation unit). FIG. 5A shows a manner in which the secondary transfer roller 9 supported by a secondary transfer roller support arm 35 is separated from the intermediate transfer belt 6. FIG. 5B shows a manner in which the eccentric cam 36 rotates at 180° to cause the secondary transfer roller 9 to be in contact with the intermediate transfer belt 6. The sheet 7 subjected to the secondary transferring operation is conveyed to a fixing device by a conveying device to melt and fix the toner image on the sheet 7.

The patch image 16 will be described below. The photosensitive drum 1 is applied with a charging bias voltage by the electric charging means 2 and uniformly electrically charged. Thereafter, the photosensitive drum 1 is exposed by the exposing unit 3 to form a patch image serving as a reference pattern to control a toner concentration at a position corresponding to a sheet interval (paper interval). More specifically, an electrostatic latent image for the formed patch image at the position corresponding to the sheet interval (paper interval) so as not to overlap the electrostatic latent image on an image corresponding to image information input from an external device such as an image scanner or a computer. As shown in FIG. 1, the electrostatic latent image is developed by the developing devices 4Y, 4M, 4C, and 4*k* to obtain the patch image 16. The patch image 16 is primarily transferred on the intermediate transfer belt 6. A concentration of the patch image 16 carried to a position of the belt roller 19 is detected by a concentration sensor 17. On the basis of the patch concentration detection signal, a image control unit 40 adjusts light quantity of the exposing unit 3 to correct and control a concentration of a toner image on the photosensitive drum 1.

A distal end of the toner image primarily transferred from the photosensitive drum 1 onto the intermediate transfer belt 6 is carried to the secondary transfer portion T2 constituted by the counter 21 and the secondary transfer roller 9 to reach the secondary transfer portion T2.

Before the toner image reaches the secondary transfer portion T2, the secondary transfer roller 9 separated during the primary transferring operation is brought into contact with the intermediate transfer belt 6 by the rotation of the eccentric cam 36. In synchronism with a timing when the toner image reaches the secondary transfer portion T2, the registration roller 8 controls conveyance of the sheet 7. Under this control, a secondary transfer bias (secondary transfer voltage) is applied from a secondary transfer bias source 211 to the counter roller 21. For example, when a transfer bias voltage of −20 to −6000 V having the same polarity as that of toner is applied to the counter roller 21, a current of −10 to −50 μA flows between the counter roller 21 and the secondary transfer roller 9. In this manner, the four full-color images overlapped on the intermediate transfer belt 6 in the secondary transfer portion T2 is transferred onto the sheet 7 at once, and a full-color unfixed toner image is formed on the sheet 7.

As described above, the fur brush roller 29 which removes toner from the secondary transfer roller 9 is arranged. The fur brush roller 29 moves together with the secondary transfer roller 9. While the secondary transfer roller 9 is in contact with and separated from the intermediate transfer belt 6, the fur brush roller 29 is in contact with the secondary transfer roller 9 to remove the toner.

While the secondary transfer roller 9 is in contact with the intermediate transfer belt 6, the secondary transfer roller 9 rotates together with the intermediate transfer belt 6 and rotates at a peripheral velocity of 285 mm/s which is equal to the peripheral velocity of the intermediate transfer belt 6. However, the secondary transfer roller 9 is separated from the intermediate transfer belt 6, transmission of the force from the intermediate transfer belt 6 to the secondary transfer roller 9 is interrupted, and the fur brush roller 29 is loaded, so that the peripheral velocity of the secondary transfer roller 9 becomes low. A difference between the peripheral velocities of the secondary transfer roller 9 and the fur brush roller 29 decreases to reduce the toner scratching force of the fur brush roller 29, so that the toner cannot be sufficiently removed.

Figure 3:
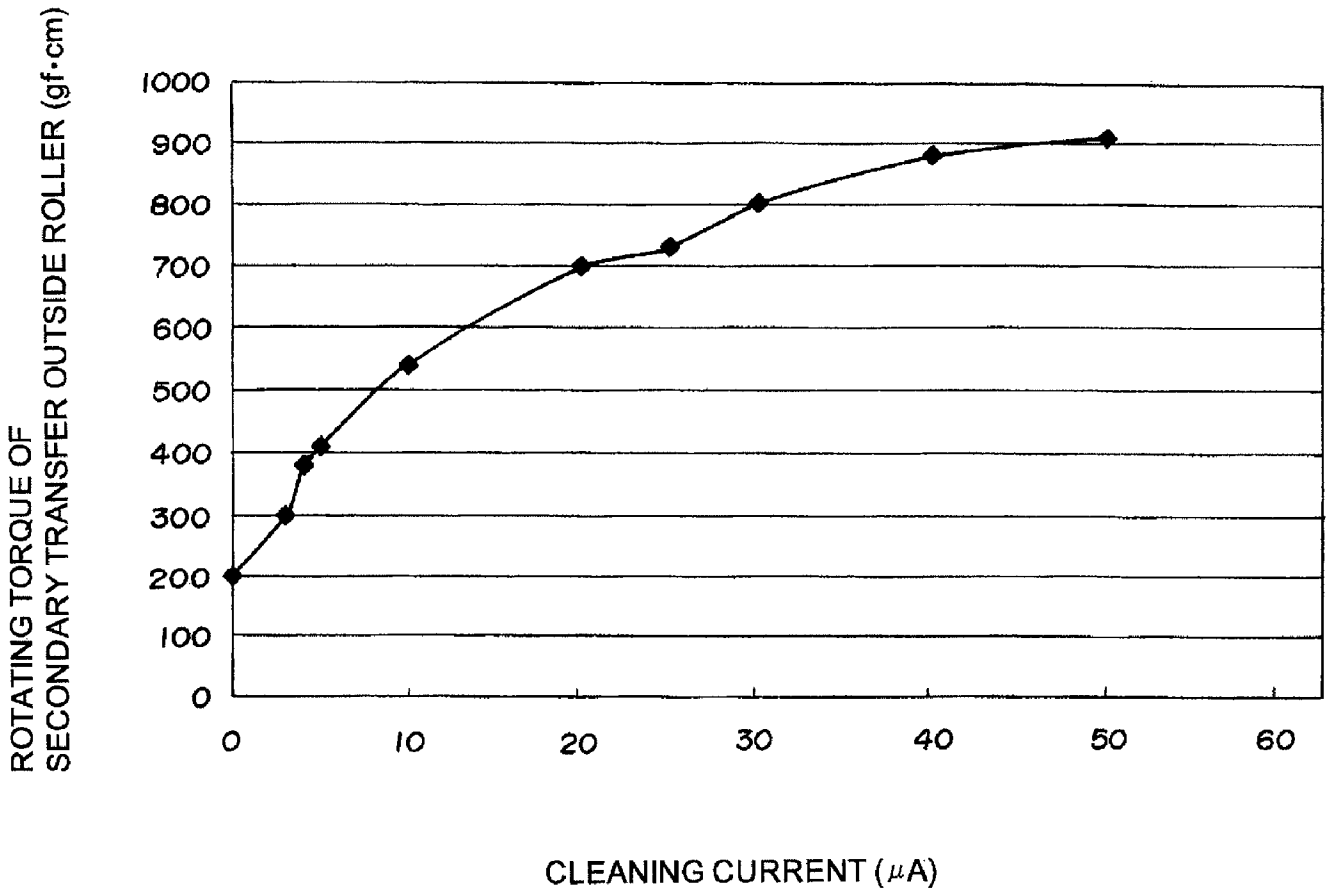
FIG. 3 is a graph showing a relationship between a cleaning current and a rotating torque of a secondary transfer roller.

FIG. 3 shows a relationship between a current value of a cleaning current flowing between the secondary transfer roller 9 and the fur brush roller 29 and a rotating torque of the secondary transfer roller 9. As shown in FIG. 3, as the cleaning current increases, the rotating torque of the secondary transfer roller 9 increases.

Figure 4:
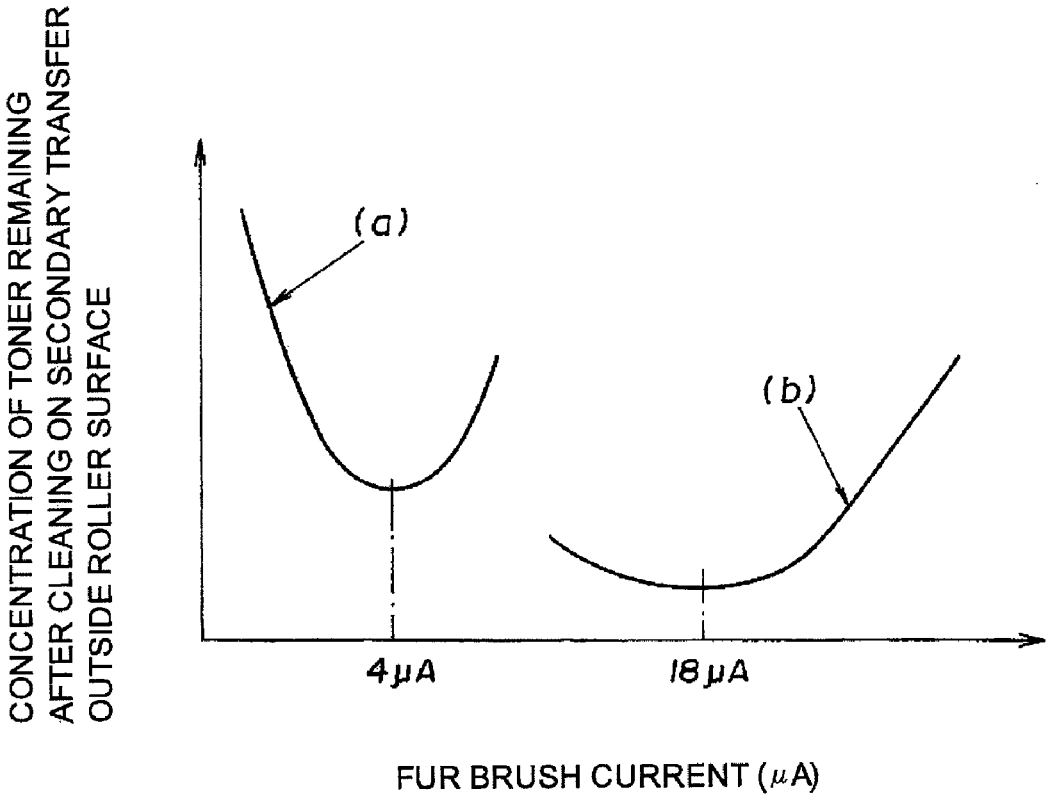
FIG. 4 is graph showing a relationship between a cleaning current and a concentration of toner remaining after cleaning on the surface of the secondary transfer roller, when the secondary transfer roller is separated from and in contact with the intermediate transfer belt, respectively.

Therefore, while the secondary transfer roller 9 is separated from the intermediate transfer belt 6, the cleaning current is reduced to prevent the difference between the peripheral velocities of the secondary transfer roller 9 and the fur brush roller 29 from decreasing. FIG. 4 shows a relationship between a cleaning current value and a concentration of toner remaining after cleaning on the surface of the secondary transfer roller while the secondary transfer roller 9 is in contact with and separated from the intermediate transfer belt 6. A curve (a) in FIG. 4 shows a case in which the secondary transfer roller 9 is separated from the intermediate transfer belt 6. A curve (b) shows a case in which the secondary transfer roller 9 is in contact with the intermediate transfer belt 6.

When the secondary transfer roller 9 is separated, electrostatic cleaning force decreases because the cleaning current decreases. However, the difference between the peripheral velocities of the secondary transfer roller 9 and the fur brush roller 29 is assured, so that toner can be sufficiently removed.

Figure 6:
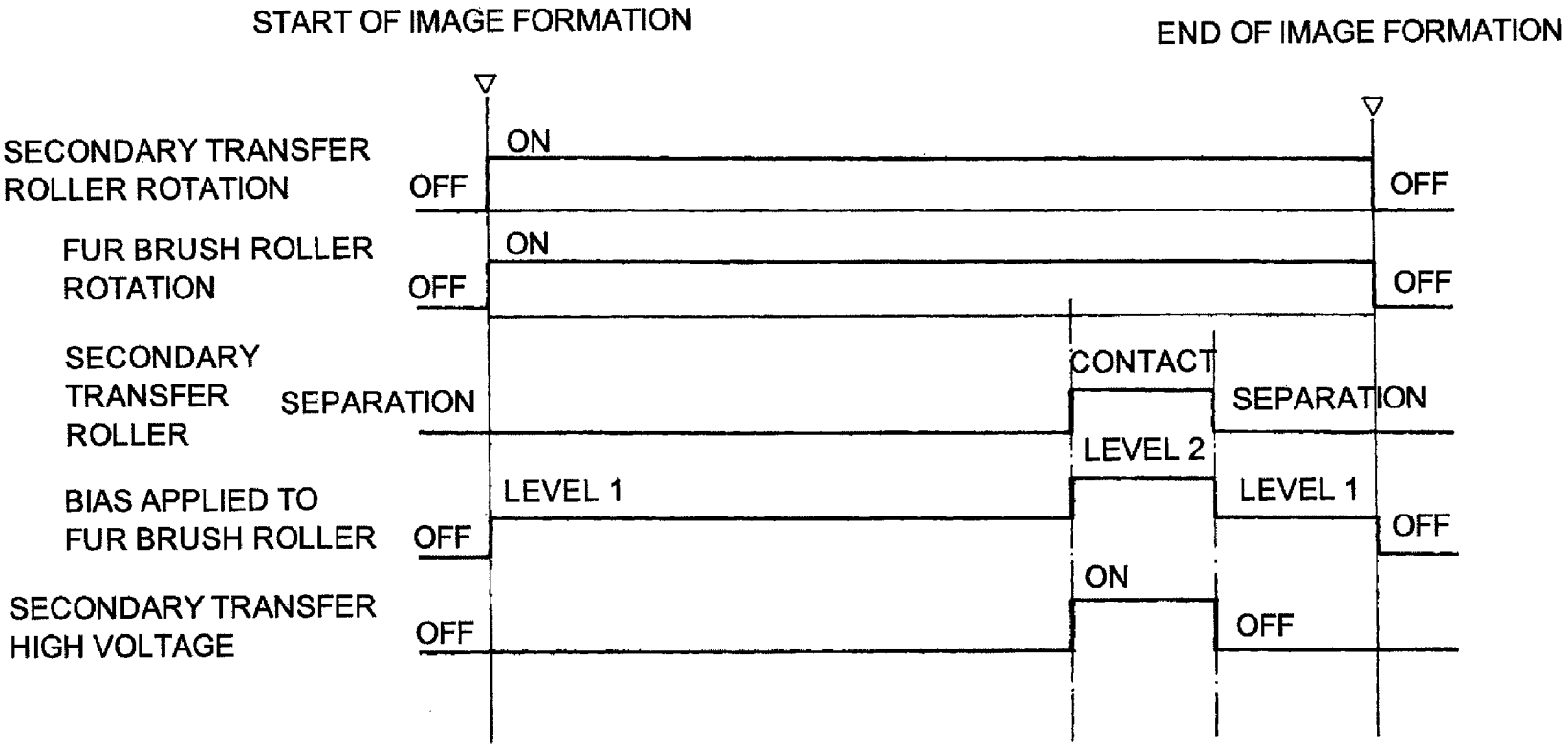
FIG. 6 is a time chart mainly showing an operation of a secondary transfer roller according to the embodiment.

FIG. 6 is a timing chart mainly showing an operation of the secondary transfer roller 9 in the image formation.

When a signal for starting image formation is input to the main body of the image forming apparatus which is set in a standby state where the secondary transfer roller 9 is separated from the intermediate transfer belt 6, the operations of the motor 34 which rotationally drives the secondary transfer roller 9 and a motor (not shown) which rotates the fur brush roller 29 are turned on. The cleaning bias source (voltage applying unit) 31 applies a voltage of +50 V (level 1 in FIG. 3) having a polarity opposing the polarity of toner to the fur brush roller 29 through the bias roller 30. At this time, a current of 4 μA flows between the secondary transfer roller 9 and the fur brush roller 29. In the separation state, the fur brush roller 29 rotates at a peripheral velocity of 287 mm/s.

While the toner images Y, M, C, and K on the photosensitive drum 1 are sequentially primarily transferred onto the secondary transfer roller 9, the secondary transfer roller 9 is cleaned by the fur brush roller 29 while the secondary transfer roller 9 separated from intermediate transfer belt 6.

When the cleaning current flows between the fur brush roller 29 and the secondary transfer roller 9, the secondary transfer roller 9 rotates at least once, and the eccentric cam 36 rotates before the toner image on the secondary transfer roller 9 reaches the secondary transfer portion T2.

With the rotation of the eccentric cam 36, the secondary transfer roller 9 is brought into contact with the intermediate transfer belt 6. When the secondary transfer roller 9 is brought into contact with the intermediate transfer belt 6, a cleaning voltage source controller 311 changes an output from the cleaning voltage source to +100 V (level 2 in FIG. 3). At this time, a current of +18 μA flows between the secondary transfer roller 9 and the fur brush roller 29. When the cleaning current flows between the secondary transfer roller 9 and the fur brush roller 29, a secondary transfer bias is applied to the counter roller 21, and a toner image on the intermediate transfer belt 6 is secondarily transferred onto the sheet 7.

In this case, the cleaning bias source 31 is used as a power source controlled at a constant current, a current of +3 μA to +5 μA can be applied when the secondary transfer roller 9 is separated from the intermediate transfer belt 6. When the secondary transfer roller 9 is in contact with the intermediate transfer belt 6, a current of +15 μA to +20 μA can be applied.

Subsequently, a rear end of the secondarily transferred toner image on the intermediate transfer belt 6 passes through the secondary transfer portion T2, the eccentric cam 36 rotates again, and the secondary transfer roller 9 is separated from the intermediate transfer belt 6. With this separation, the cleaning voltage source controller 311 changes an output from the cleaning power supply to +50 V. At this time, a current of +4 μA flows between the secondary transfer roller 9 and the fur brush roller 29. In a state in which the secondary transfer roller 9 is cleaned while being separated from the intermediate transfer belt 6, when the secondary transfer roller 9 rotates once or more, the secondary transfer roller 9 and the fur brush roller 29 are stopped, and a voltage applied from the cleaning bias source 31 to the fur brush roller 29 is also stopped.

As is apparent from the foregoing description, depending on the two states in which the secondary transfer roller 9 is in contact with and separated from the intermediate transfer belt 6, voltages applied to the fur brush roller 29 are changed.

More specifically, current values of currents flowing between the secondary transfer roller 9 and the fur brush roller 29 are different from each other, the currents having the current values suitable for each of the contact state and the separation state flow. Therefore, the surface of the secondary transfer roller 9 can be efficiently cleaned.

In the embodiment, the torque limiter 33 is arranged for the secondary transfer roller 9. However, even in an image forming apparatus which does not include the torque limiter 33, an image forming apparatus in which the velocity of the secondary transfer roller 9 is changed by separating the secondary transfer roller 9 from the intermediate transfer belt 6 achieves the same effect as described above.

The present invention is not limited to the above embodiment, other embodiments applications, modifications, and combinations thereof can be available without departing from the spirit and scope of the invention.

This application claims the benefit of priority from the prior Japanese Patent Application No. 2006-101826 filed on Apr. 3, 2006 the entire contents of which are incorporated by reference herein.

What is claimed is:

1. An image forming apparatus comprising:

an image bearing member, which bears a toner image;

a rotatable transfer roller, which is grounded and forms a transfer portion to transfer the toner image formed on the image bearing member onto a recording material;

a contact separation mechanism, which brings the transfer roller into contact with the image bearing member and separates the transfer roller from the image bearing member;

a driving force transmission portion, which transmits a driving force from a driving source to the transfer roller at least while the transfer roller is separated from the image bearing member;

a cleaning member for removing toner adhering to the transfer roller by contacting with the transfer roller while the transfer roller is in contact with and separated from the image bearing member, wherein the cleaning member is electrically conductive and cleans the transfer roller in:

(i) a first mode in which the cleaning member cleans the transfer roller while the transfer roller is in contact with the image bearing member and rotates at a first peripheral velocity, and (ii) a second mode in which the cleaning member cleans the transfer roller while the transfer roller is separated from the image bearing member and rotates at a second peripheral velocity, which is smaller than the first peripheral velocity; and a control portion, which controls an electric field applied between the cleaning member and the transfer roller such that an absolute value of the electric field applied between the cleaning member and the transfer roller in the second mode is smaller than an absolute value of the electric field applied between the cleaning member and the transfer roller in the first mode.

2. The image forming apparatus according to claim 1, wherein the cleaning member is rotatable, and at least while in the first mode and the second mode, the cleaning member is rotated, and a peripheral velocity difference between the first peripheral velocity of the transfer roller and a peripheral velocity of the cleaning member in the first mode is larger than a peripheral velocity difference between the second peripheral velocity of the transfer roller and a peripheral velocity of the cleaning member in the second mode.

3. The image forming apparatus according to claim 2, wherein the cleaning member is rotated in a counter direction at a contacting portion formed between the cleaning member and the transfer roller.

4. The image forming apparatus according to claim 2, wherein the cleaning member is a fur brush roller.

5. The image forming apparatus according to claim 1, further comprising a torque limiter located in the driving force transmission portion, wherein while the transfer roller is in contact with the image bearing member, the torque limiter limits a transmission of the driving force from the driving source to the transfer roller, and wherein while the transfer roller is separated from the image bearing member, the torque limiter does not limit a transmission of the driving force from the driving source to the transfer roller.

6. The image forming apparatus according to claim 1, further comprising a bias roller contacted with the cleaning member, wherein the bias roller is applied with a voltage having a polarity opposite to a polarity of a toner.

* * * * *